US006160981A

United States Patent [19]

Williams et al.

[11] Patent Number: 6,160,981

[45] Date of Patent: Dec. 12, 2000

[54] TRANSFER SYSTEM

[75] Inventors: Lloyd A. Williams, Mahopac; Joannes N. M. deJong, Suffern; Grace T. Brewington, Fairport; John Buranicz, Rochester, all of N.Y.

[73] Assignee: Xerox Corporation, Stamford, Conn.

[21] Appl. No.: 09/356,657

[22] Filed: Jul. 19, 1999

[51] Int. Cl.[7] ..... G03G 15/01

[52] U.S. Cl. ..... 399/304; 399/303

[58] Field of Search ..... 399/303, 304, 399/301, 312

[56] References Cited

U.S. PATENT DOCUMENTS

| | | | |
|---|---|---|---|
| 4,072,412 | 2/1978 | Suda et al. | 399/304 |
| 4,723,145 | 2/1988 | Takada et al. | 399/304 X |
| 5,075,734 | 12/1991 | Durland et al. . | |
| 5,138,399 | 8/1992 | Castelli et al. | 399/304 |
| 5,200,791 | 4/1993 | Dastin et al. | 399/301 |
| 5,406,358 | 4/1995 | Kimura et al. | 399/304 |
| 5,508,789 | 4/1996 | Castelli et al. . | |

*Primary Examiner*—Susan S. Y. Lee
*Attorney, Agent, or Firm*—H. Fleischer

[57] ABSTRACT

A multi-color electrophotographic printing machine in which the tangential velocity of the photoconductive drum in the transfer zone is greater than the tangential velocity of the transfer drum having the sheet receiving the transferred images thereon. A buckle is formed in the sheet after the transfer zone, resulting in the sheet being tacked to the developed image on the photoconductive member and moving at the same tangential velocity as the developed image. This is achieved by a transfer sheet having one end secured fixedly over an aperture in the transfer drum. The other end of the transfer sheet is resiliently secured to the transfer drum. The sheet of support material receiving the transferred images is secured at the leading edge to the transfer sheet. In this way, the transfer sheet and the sheet of support material may be induced to form a buckle after the transfer zone enabling the sheet of support material and the developed image to move at the same tangential velocity. By moving at the same tangential velocity, the image smear is eliminated during transfer.

11 Claims, 5 Drawing Sheets

TRANSFER SYSTEM

This invention relates generally to a multicolor electrophotographic printing machine, and more particularly concerns a transfer apparatus used therein for transferring successive developed images from a photoconductive surface to a sheet in superimposed registration with one another.

A typical electrophotographic printing machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document. After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image forming a visible powder image on the photoconductive surface. After the electrostatic latent image is developed with the toner particles, the toner powder image is transferred to a sheet. Thereafter, the toner image is heated to permanently fuse it to the sheets.

It is highly desirable to use an electrophotographic printing machine of this type to produce color prints. In order to produce a color print, it is frequently necessary to form yellow, magenta and cyan color separations. One skilled in the art will appreciate that the black separation can be made either first or last with respect to the other color separations. In this way, a permanent color print is formed. In the process of multicolor printing, the copy sheet moves from an input tray through a recirculating path internal to the printing machine where a plurality of toner images are transferred thereto and then to an output catch tray for subsequent removal. A sheet gripper secures the copy sheet to a transport which transports the sheet in a recirculating path enabling successive different color images to be transferred thereto. The sheet gripper grips one edge of the copy sheet and moves the sheet in a recirculating path so that accurate multi-pass color registration is achieved. In this way, the magenta, cyan, yellow and black toner images are transferred to the copy sheet in superimposed registration with one another.

The angular velocities of the photoconductive drum and transfer drum are precisely controlled with high performance servo systems. This makes the drums rotate synchronously yielding lead edge registration and large reductions of repeatable once-around errors. However, since the drum diameters are not identical, the tangential velocities at the transfer zone of the photoconductive drum and the transfer drum differ slightly. This difference in velocities causes slip between the sheet secured fixedly to the transfer drum and the toner image on the photoconductive drum. This results in a degradation in image quality, such as blurred or smeared images being produced on the sheet.

Various types of multi-color printing machines have heretofore been employed. The following disclosures may be relevant to various aspects of the present invention:

U.S. Pat. No. 5,075,734

Patentee: Durland et al.

Issued: Dec. 24, 1991

U.S. Pat. No. 5,508,789

Patentee: Castelli et al.

Issued: Apr. 16, 1996

U.S. Pat. No. 5,075,734 discloses a multi-color electrophotographic printing machine in which the leading portion of the sheet is advanced through the transfer zone at a first velocity and the trailing portion of the sheet is advanced in a region immediately behind the transfer zone at a second velocity. The second velocity is greater than the first velocity to create a buckle in the trailing portion of the sheet in the region prior to transfer. The buckle functions to eliminate relative velocity between the photoconductive belt and any portion of the sheet within the transfer zone so as to substantially eliminate slip between the sheet and the photoconductive belt.

U.S. Pat. No. 5,508,789 discloses slewing the velocity of a photoconductive belt over a range of speeds while monitoring an output control signal current of a drive motor. The resulting control signal current has a large oscillation at the velocity at which the speed of the photoconductive belt and the intermediate transfer roll are matched. A controller is then used to maintain the motor velocity at a speed slightly less than or slightly greater than that of the intermediate transfer roll speed so as to prevent a change in sign of the relative velocity between the two moving surfaces.

In accordance with one aspect of the present invention, there is provided a method of transferring a developed image to receiving member at a transfer zone. The receiving member is moved at first velocity. The developed image is moved at a second velocity greater than the first velocity. The receiving member is tacked to the developed image in the transfer zone so that the receiving member and the developed image move at the second velocity in the transfer zone. This causes buckling of the receiving member after the transfer zone. The developed image is transferred to the receiving member in the transfer zone.

Pursuant to another aspect of the present invention, there is provided an apparatus for transferring, at a transfer region, a developed image from a rotating photoconductive drum to a sheet of support material secured releasably to a rotating transfer drum. The transfer drum includes a cylindrically shaped sleeve having an aperture in a portion of the circumferential surface thereof. A transfer sheet is positioned over the aperture and secured fixedly at a lead edge to the sleeve and resiliently at a trailing edge to the sleeve. The lead edge of the sheet is secured fixedly to the transfer sheet and the trailing edge of the sheet is unsecured and substantially free. The transfer drum and the photoconductive drum rotate at substantially equal angular velocities. The diameter of the photoconductive drum is greater than the diameter of the transfer drum. The photoconductive drum tangential velocity is greater than that of the transfer drum in the transfer zone. A transfer roll is positioned interiorly of the sleeve adjacent the transfer sheet. A mechanism coupled to the transfer roll moves the transfer sheet adjacent the photoconductive member to define a nip therebetween through which the sheet moves. An electrical biasing device, operatively associated with the transfer roll, electrically bias the transfer roll, and tacks the sheet to the photoconductive drum in the transfer region with the sheet moving at the same tangential velocity as the photoconductive drum in the transfer region causing the sheet to buckle after the transfer region.

Still another aspect of the present invention includes a printing machine of the type having a photoconductive drum with a developed image formed thereon being transferred to a receiving medium. The improvement includes a transfer drum having an aperture in a portion of the circumferential surface thereof. A transfer sheet positioned over the aperture in the transfer drum, is secured fixedly at a lead edge to the transfer drum and resiliently at a trailing edge to the transfer drum. A lead edge of the receiving medium is secured fixedly to the transfer sheet and the tailing edge of the receiving medium is unsecured and substantially free. The transfer drum and the photoconductive drum rotate at substantially equal angular velocities with the photoconductive drum diameter being greater than the transfer drum diameter so that the photoconductive drum tangential velocity is greater than the transfer drum tangential velocity in the transfer zone. A transfer roll is disposed interiorly of the transfer drum adjacent the transfer sheet. A mechanism is coupled to the transfer roll to move the transfer sheet adjacent the photoconductive to define a nip therebetween through which the receiving medium moves. An electrical biasing device, operatively associated with the transfer roll, electrically biases and tacks the receiving medium to the photoconductive drum in the transfer region with the receiving medium moving at the same tangential velocity as the photoconductive drum in the transfer region causing the receiving medium to buckle after the transfer region.

Other aspects of the present invention will become apparent as the following description proceeds and upon reference to the drawings, in which.

Figure 1:
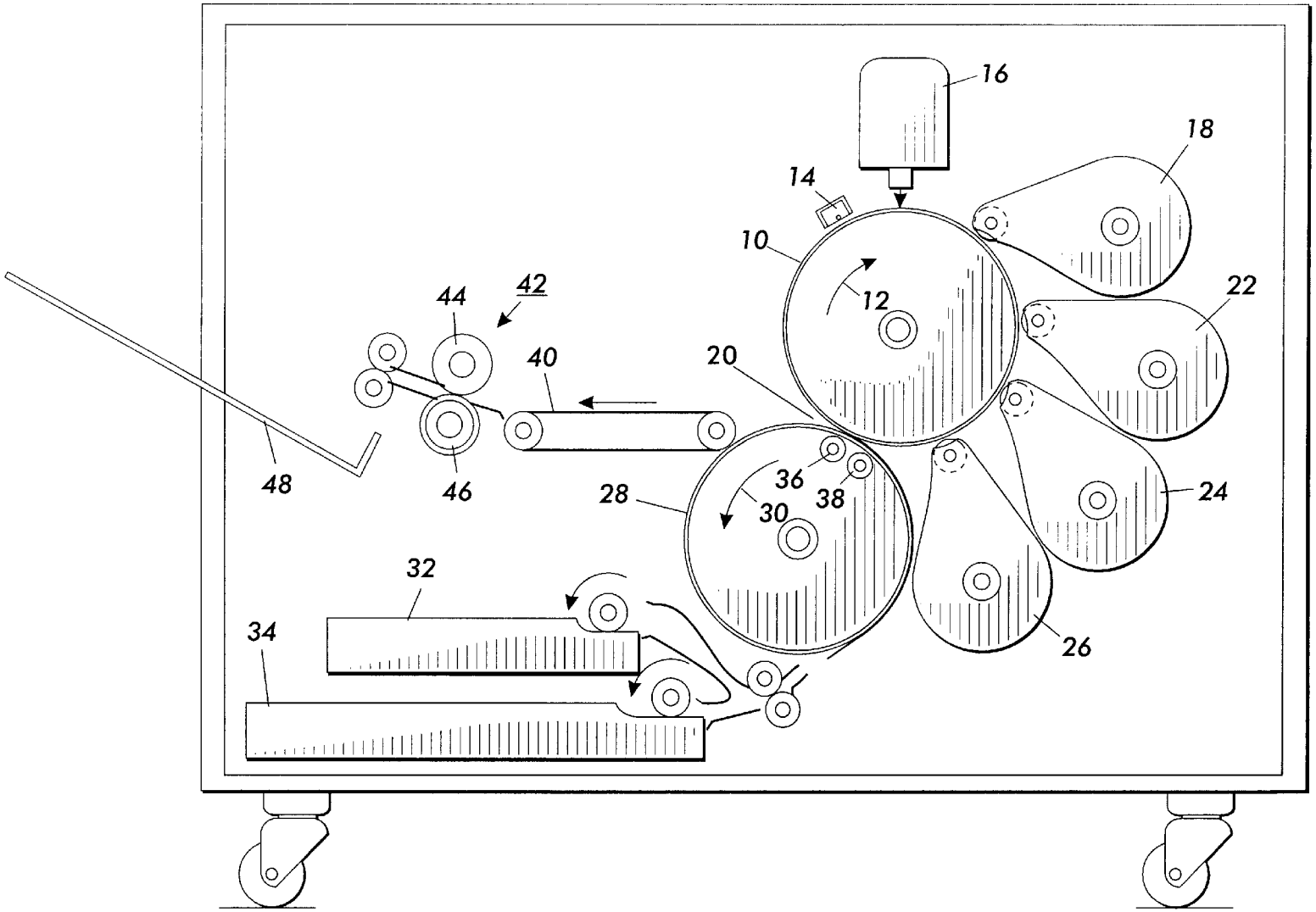
FIG. 1 is a schematic, elevational view showing a multipass, multicolor electrophotographic printing machine incorporating the features of the present invention therein.

While the present invention will hereinafter be described in connection with the preferred embodiment and method of use, it will be understood that it is not intended to limit the invention to that embodiment and method of use. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements.

Referring initially to FIG. 1, there is shown a multipass, multicolor electrophotographic printing machine. As shown thereat, photoconductive drum 10 is coupled to a suitable motor and servo mechanism so as to rotatably driven thereby at substantially constant angular velocity. In this way, photoconductive drum 10 rotates in the direction of arrow 12.

Initially, photoconductive drum 10 passes through a charging station. At the charging station, a corona generating device 14, charges the photoconductive surface of drum 10 to a relatively high, substantially uniform potential.

After the photoconductive drum 10 is charged, the charged portion thereof is advanced to an exposure station. At the exposure station, an imaging beam generated by a raster output scanner 16 exposes the charged portion of the photoconductive surface to record a color separated electrostatic latent image thereon. This color separated electrostatic latent image is developed by developer unit 18.

Developer unit 18 develops the electrostatic latent image recorded on photoconductive drum 10 with yellow toner particles.

After the electrostatic latent image has been developed with the yellow toner, drum 10 continues to advance in the direction of arrow 12 to transfer station 20. At transfer station 20, a sheet of support material advancing on transfer drum 28 rotating in the direction of arrow 30 has the yellow toner powder image transferred from photoconductive drum 10 thereto. A sheet of support material, i.e., paper, is advanced from stack 32 or stack 34 to transfer drum 28. A pair of bias transfer rolls 36 and 38 generate an electrical field which attracts the yellow toner powder image from the photoconductive drum 10 to the sheet of support material adhering to transfer drum 28 at transfer station 20. The biased transfer rolls are electrically biased to the appropriate magnitude and polarity to attract the yellow toner powder image from photoconductive drum 10 to the sheet of support material. Further details of the transfer station 20 and transfer drum 28 will be shown hereinafter with reference to FIGS. 2–4, inclusive. After the yellow toner powder image has been transferred to the sheet of support material, drum 10 rotates to charging station 14.

Prior to charging, drum 10 rotates to a cleaning which removes the residual particles therefrom.

At charging station 14, corona generating device charges the photoconductive surface of drum 10 to a relatively high, substantially uniform potential. Thereafter, another imaging beam from ROS 16 selectively discharges the charge on the photoconductive surface to record a partial electrostatic latent image for development with magenta toner particles. After the latent image is recorded on the photoconductive surface, drum 10 advances the latent image to the magenta developer unit 22.

The magenta developer unit deposits magenta toner particles on drum 10 to form a magenta toner powder image thereon.

After the magenta toner image has been formed on the photoconductive surface of drum 10, drum 10 advances in the direction of arrow 12 to transfer station 20. At transfer station 20, the sheet of support material advancing on transfer drum 28 rotating in the direction of arrow 30 has the magenta toner powder image transferred from photoconductive drum 10 thereto in superimposed registration with the yellow toner powder image.

Prior to charging, drum 10 rotates to the cleaning station which removes the residual particles therefrom. At charging station 14, the corona generator recharges the photoconductive surface of drum 10 to a relatively high, substantially uniform potential. Thereafter, another imaging beam from ROS 16 selectively discharges those portions of the charge photoconductive surface of drum 10 which are to be developed with cyan toner. The latent image to be developed with cyan toner is advanced to the cyan developer unit 24.

At the cyan developer unit, cyan toner particles are deposited on the latent image to produce a cyan toner powder image.

After the cyan toner powder image is developed on photoconductive drum 10, drum 10 advances to transfer station 20. At transfer station 20, the sheet of support material advancing on transfer drum 28 rotating in the direction of arrow 30 has the cyan toner powder image transferred from photoconductive drum 10 thereto in superimposed registration with the yellow and magenta toner powder images. Thereafter, the photoconductive drum returns to the charging station.

Prior to charging drum 10, drum rotates to the cleaning station which removes the residual particles therefrom. At charging station 16, photoconductive drum 10 is recharged to a relatively high, substantially uniform potential. Thereafter, a different imaging beam generated by ROS output scanner 16 exposes the charge portion of the photoconductive drum to record a color separated electrostatic latent image thereon. This color separated electrostatic latent image is developed by developer unit 26. Developer unit 26 develops the electrostatic latent image recorded on photoconductive drum 10 with black toner particles. The black developer unit deposits black toner particles on drum 10. After the black toner powder image is developed on photoconductive drum 10, drum 10 advances to transfer station 20.

At transfer station 20, the sheet of support material advancing on transfer drum 28 rotating in the direction of arrow 30 has the black toner powder image in superimposed registration with the yellow, magenta, and cyan toner powder images. After the toner powder images have been transferred to the sheet of support material, the sheet of support material is advanced on transport 40 to fusing station 42.

The fusing station 42 includes a heated fuser roll 44 and a backup roll 46. The backup roller is resiliently urged into engagement with fuser roll to form a nip through which the sheet of paper passes. In the fusing operation, the toner particles coalesce with one another and bond to the sheet in image configuration forming a multicolor image thereon. After fusing, the finished sheet is discharged to a finishing station 48. At the finishing station, a plurality of sheets may be bound together either by stapling and/or by applying an adhesive thereto to form a set of sheets. This set of sheets is then advanced to a catch tray for subsequent removal therefrom by the machine operator. A multiplicity of finishing devices, such as a sorter, stapler, etc., may be attached to the printing machine.

After the toner powder images have been transferred to the sheet of support material, the photoconductive drum is cleaned. One type of cleaning system is a plurality of cleaning brush which are brought into contact with the photoconductive drum to remove residual particles adhering to the photoconductive drum. These particles are cleaned from the photoconductive drum after the transfer of the multicolor toner powder image therefrom at the cleaning station.

Figure 2:
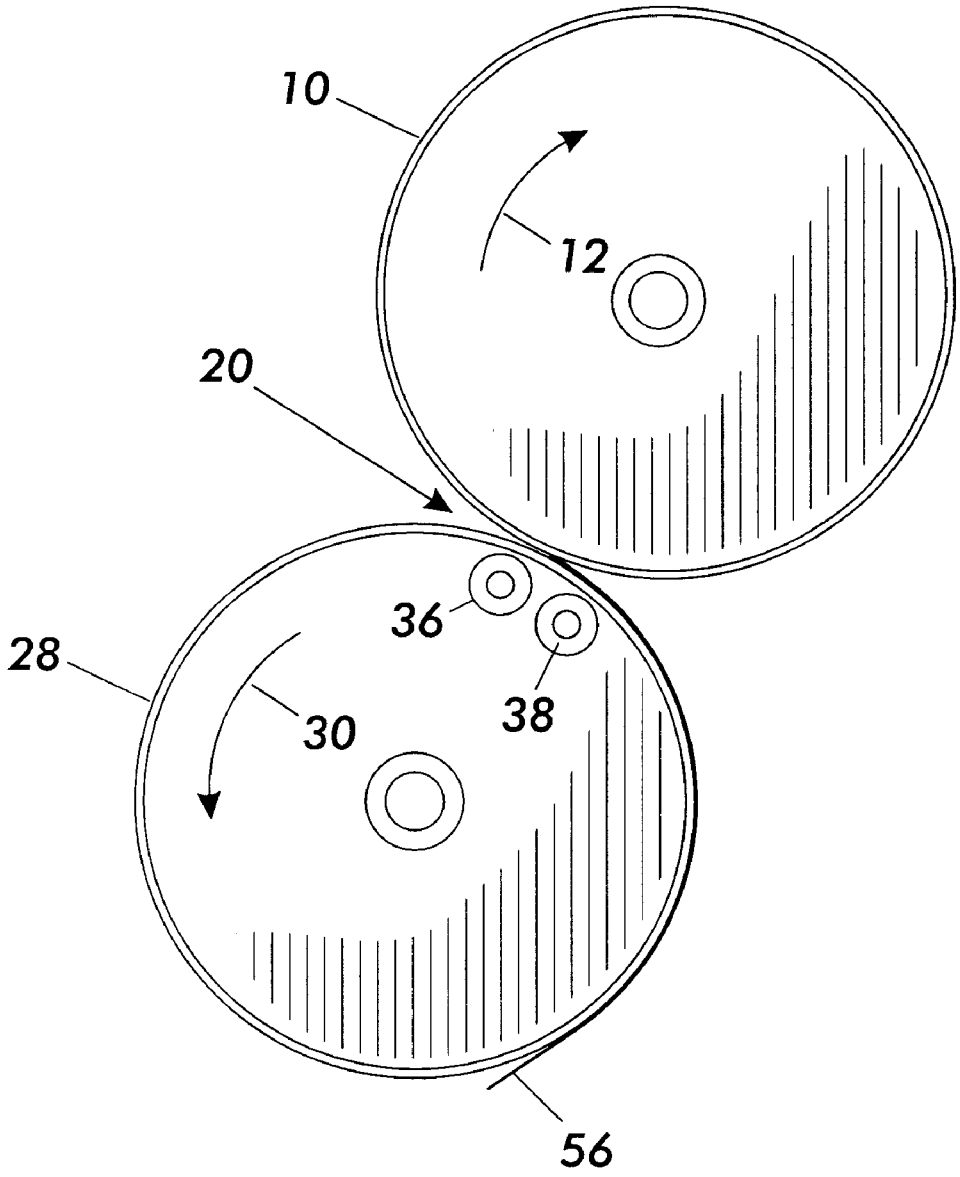
FIG. 2 is a schematic, elevational view depicting the transfer region of the FIG. 1 printing machine.

Referring now to FIG. 2, there is shown transfer station 20 and the associated apparatus of transfer drum 28 and photoconductive drum 10 in greater detail. As depicted thereat, electrically biased transfer rolls 36 and 38 are disposed interiorly of transfer drum 28. The pair of biased transfer rolls 36 and 38 generate an electrical field which attracts the toner powder images from the photoconductive drum 10 to the sheet of support material adhering to transfer drum 28 at transfer station 20. The biased transfer rolls are electrically biased to the appropriate magnitude and polarity to attract the toner powder images from photoconductive drum 10 to the sheet of support material adhering to transfer drum 28. A sheet of support material is releasably attached to transfer drum 28 and rotates therewith. At each revolution of photoconductive drum 10, a toner powder image is transferred to the sheet of support material adhering to transfer drum 28. Thus, during the first revolution of photoconductive drum 10, the yellow toner powder image is transferred to the sheet adhering to transfer drum 28. During the next revolution, the magenta toner powder image is transferred from photoconductive drum to the sheet adhering to transfer drum 28. The magenta toner powder image is transferred in superimposed registration with the yellow toner image. During the next revolution, the cyan toner powder image is transferred from the photoconductive drum 10 to the sheet of support material adhering to transfer drum 28. The cyan toner powder image is transferred from the photoconductive drum to the sheet of support material in superimposed registration with the yellow and magenta toner powder images. Finally, during the fourth revolution of photoconductive drum 10, the black toner image is transferred to the sheet of support material adhering to transfer drum 28. The black toner powder image is transferred in superimposed registration with the yellow, magenta and cyan toner images. Thus, after four revolutions of photoconductive drum 10, a fully developed four color image is transferred to the sheet of support material adhering to transfer drum 28. Transfer of each toner image occurs in transfer zone 20. In transfer zone 20, the sheet of support material moves at the same tangential velocity as the toner powder image developed on photoconductive drum 10. Thus, there is no slip between the sheet of support material and the developed toner image. This will be discussed further with reference to FIGS. 3–5, inclusive.

Figure 3:
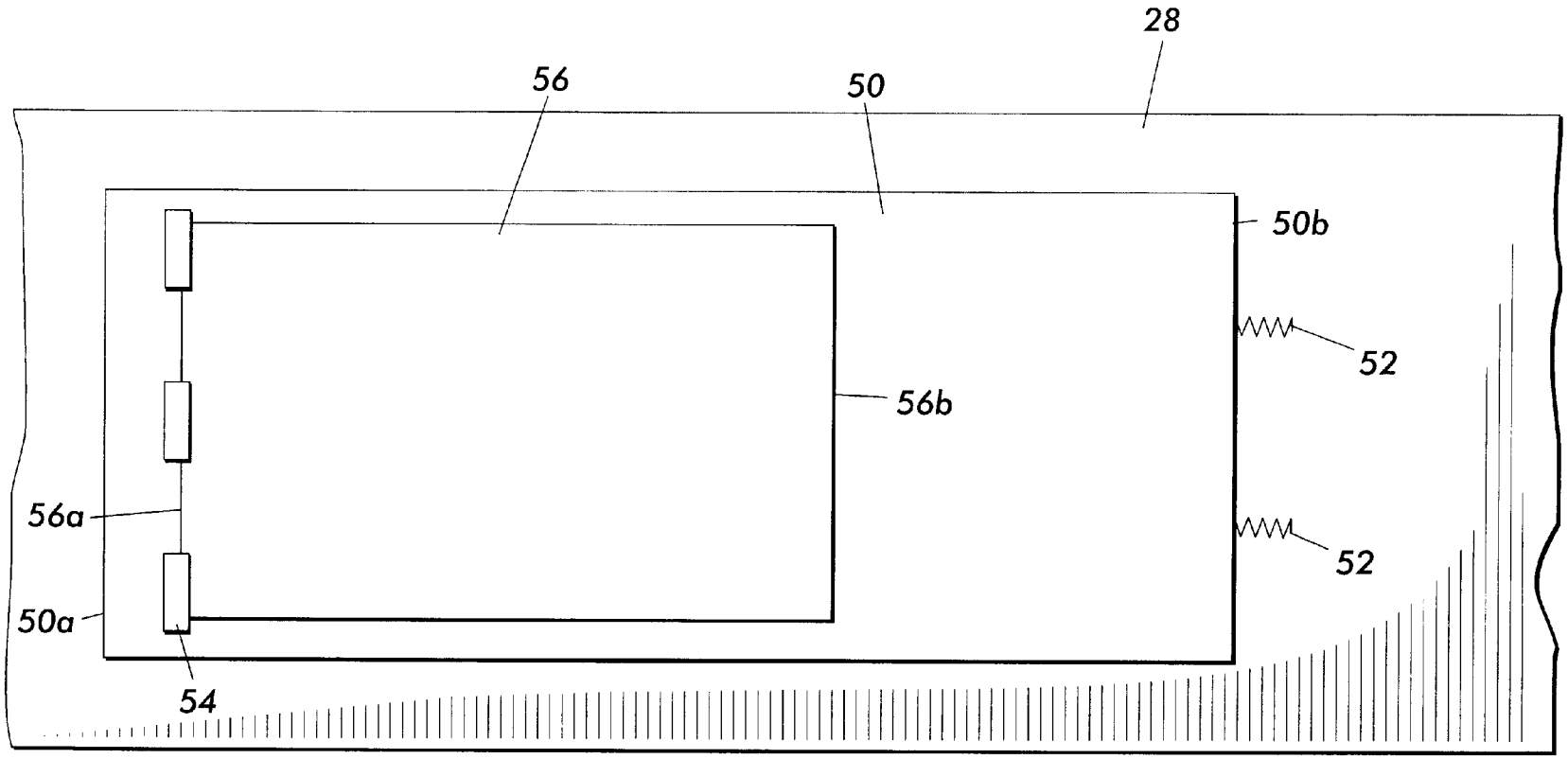
FIG. 3 is a planar, plan view of the FIG. 2 transfer drum.

Referring now to FIG. 3, transfer drum 28 is a cylindrical sleeve with electrically biased transfer rolls 36 and 38 disposed interiorly thereof. Sleeve 28 has a substantially rectangular opening or aperture therein. A sheet of transfer material 50 is wrapped across the opening in transfer drum 28. To facilitate ease of understanding, the circumference of transfer drum 28 is shown unwrapped or flat. The leading edge 50*a* of transfer sheet 50 is clamped to drum 28. The trailing edge 50*b* is attached to drum 50 with springs 52. Springs 52 are relatively soft springs. Gripper bar 54 attaches the sheets of support material 56 i.e. paper, on top of transfer sheet. Thus, leading edge 56*a* of sheet 56 is secured to transfer sheet 50 by gripper bars 54. The trailing edge 56*b* of sheet 56 is free and not secured in any manner to the transfer sheet 50. Sheet 56 is acquired by gripper bars 54 which position sheet 56 on top of transfer sheet 50. The trailing edge 56*b* of sheet 56 is not attached to transfer sheet 50 or transfer drum 28 in any manner.

Figure 4:
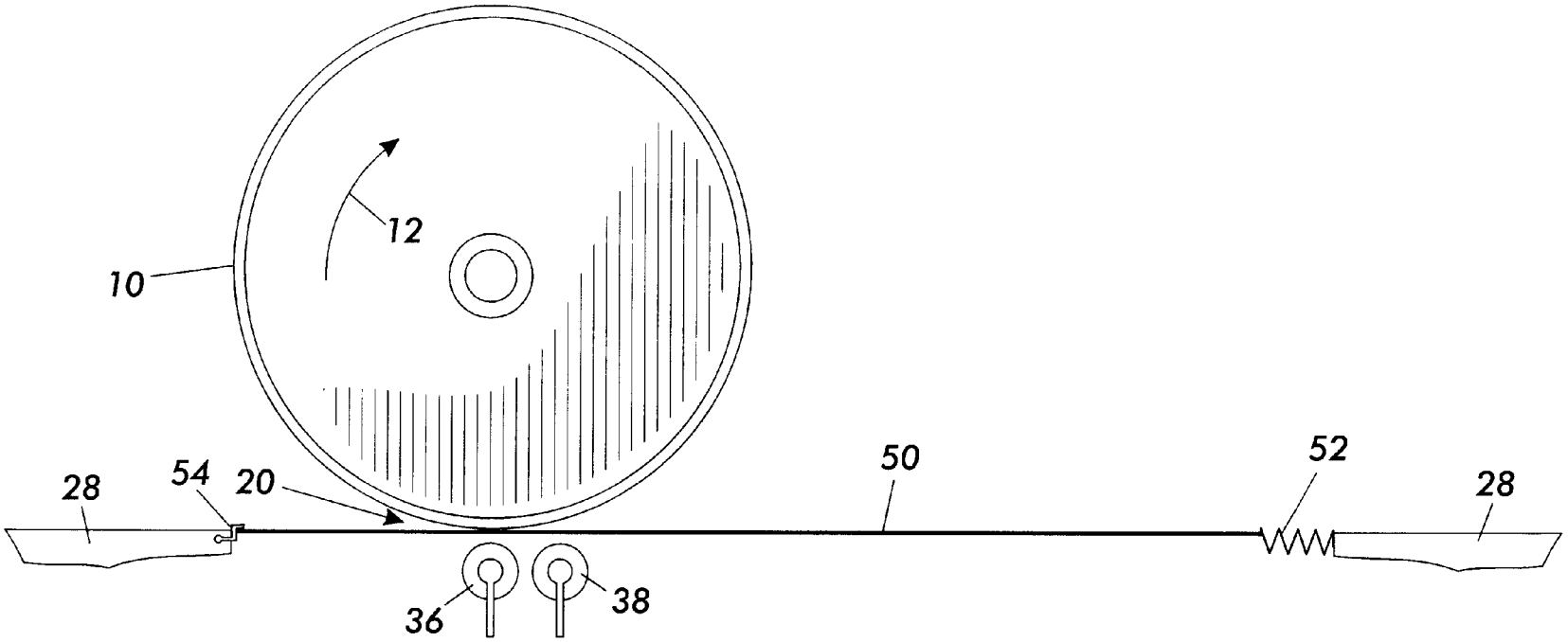
FIG. 4 is an elevational view showing a planar view of the transfer drum.

Referring now to FIG. 4, after gripper bar 54 has passed photoconductive drum 10 in transfer zone 20, bias transfer rolls 36 and 38 are moved to deflect sheet 50 forming a nip with photoconductive drum 10 through which sheet 56 passes. Rolls 36 and 38 are moved by a suitable mechanism such as a solenoid or cam mechanism. At this time, rolls 36 and 38 are electrically biased. This causes the toner particles adhering to photoconductive drum 10 to transfer to the sheet of support material 56 secured to transfer sheet 50. The angular velocities of photoconductive drum 10 and transfer drum 20 are precisely controlled by high performance servo systems. This makes the drums turn synchronously providing lead edge registration and large reductions of repeatable once-around errors. However, since the drum diameters cannot be made identical, the tangential velocities of the photoconductive drum and transfer drum differs slightly. If no special provisions were made, slip would occur in the transfer zone. By this it meant that developed image and the sheet to which it is being transferred would be moving at different tangential velocities in the transfer zone. In order to minimize degradation of copy quality, it is desirable to insure that there is no slip between the developed and the sheet of support material when transfer occurs in the transfer zone. In the present invention, this achieved by insuring that developed image and the sheet of support material move at the same tangential velocity. The foregoing will be described with reference to FIG. 5.

Figure 5:
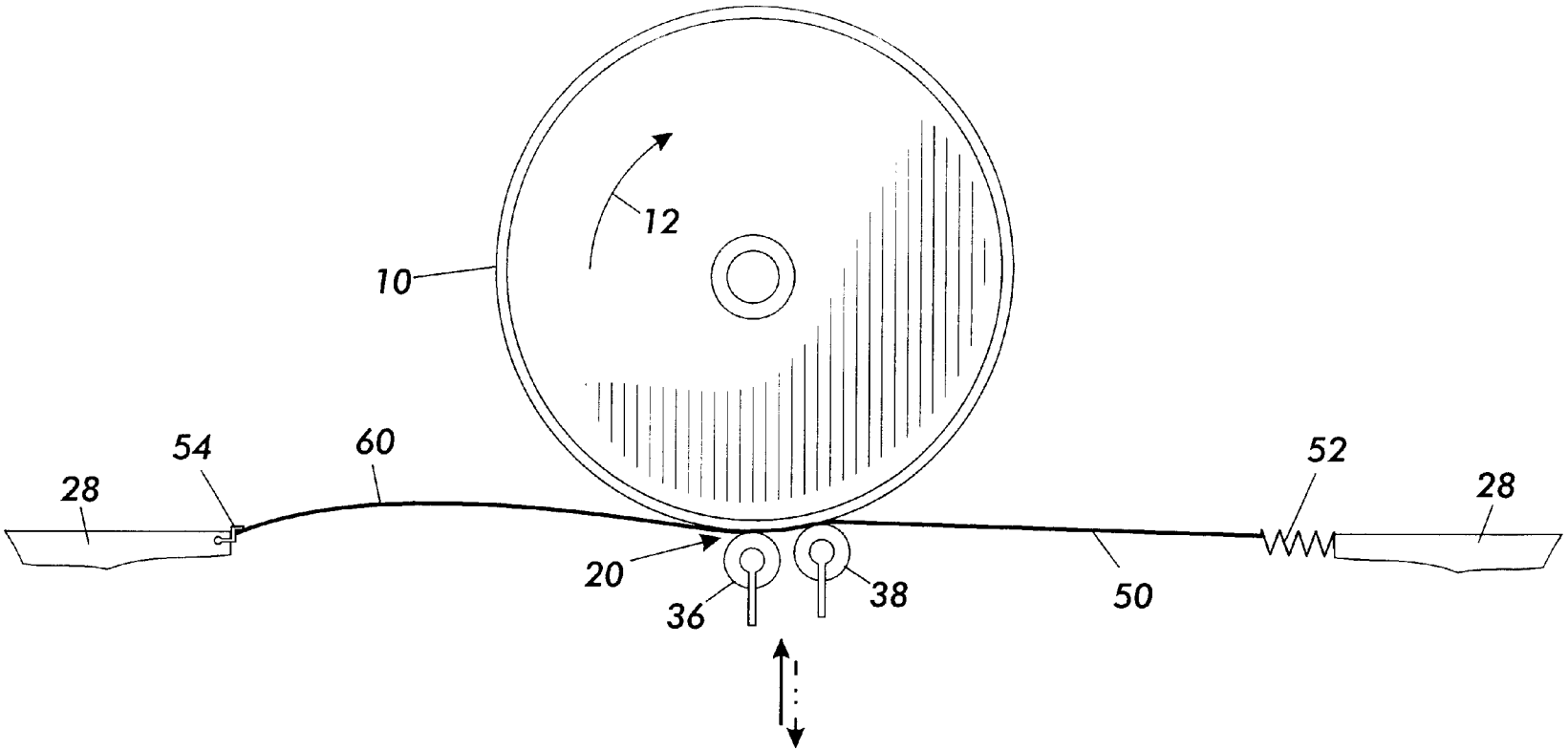
FIG. 5 is an elevational view showing a planar view of the transfer drum with the transfer sheet having a buckle therein.

Turning now to FIG. 5, the diameter of photoconductive drum 10 is greater than the diameter of transfer drum 28. As shown, bias rolls 36 and 38 have moved to position transfer sheet 50 adjacent drum 10 defining the nip through which sheet 56 passes. The difference in diameters results in photoconductive drum 10 having a higher tangential velocity in transfer zone 20 than transfer drum 28. When the bias transfer rolls 36 and 38 engage transfer sheet 56, the soft spring attachment 52 of the trailing edge of transfer sheet 50 allows extra transfer sheet 50 material and the associated sheet of support material 56 adhering thereto to be fed through the nip. This results in buckle 60 being formed in transfer sheet 50 and sheet of support material 56 in the region between gripper bars 54 and transfer zone 20. This buckle decouples the motion of the sheet of support material 56 and transfer sheet 50 from that of transfer drum 28. As a result of this, the sheet of support material moves at the same tangential velocity as that of the developed image adhering to photoconductive drum 10 in transfer zone 20. This results in there being no slip between the developed image on the photoconductive drum and the sheet of support material. In this way, the quality of the image being transferred to the sheet is optimized with no smear or degradation occurring therein.

What is claimed is:

1. An apparatus for transferring, at a transfer region, a developed image from a rotating photoconductive drum to a sheet of support material secured releasably to a rotating transfer drum, wherein the transfer drum includes:

a cylindrically shaped sleeve having an aperture in a portion of the circumferential surface thereof;

a transfer sheet, positioned over the aperture in said sleeve and secured fixedly at a lead edge to said sleeve and resiliently at a trailing edge to said sleeve with a lead edge of the sheet being secured fixedly to said transfer sheet and the trailing edge of the sheet being unsecured and substantially free with the transfer drum and the photoconductive drum rotating at substantially equal angular velocities and a diameter of the photoconductive drum being greater than a diameter of the transfer drum so that a tangential velocity of the photoconductive drum is greater than a tangential velocity of the transfer drum in a transfer zone;

a transfer roll disposed interiorly of said sleeve adjacent said transfer sheet;

a mechanism coupled to said transfer roll to move said transfer sheet adjacent the photoconductive drum to define a nip therebetween through which the sheet moves; and an electrical biasing device, operatively associated with said transfer roll, electrically biases said transfer roll and tacks the sheet to the photoconductive drum in the transfer region with the sheet moving at the same tangential velocity as the photoconductive drum in the transfer region causing the sheet to buckle after the transfer region.

2. An apparatus according to claim 1, wherein the sheet buckles in the region between the leading edge secured to said transfer sheet and the transfer region.

3. An apparatus according to claim 2, further including:

a spring attaching resiliently the trailing edge of the transfer sheet to the sleeve; and a clamping device attaching fixedly the leading edge of the transfer sheet to said sleeve.

4. An apparatus according to claim 3, further including:

a first servo system, operatively associated with said sleeve, to control the angular velocity thereof; and a second servo system, operatively associated with the photoconductive drum, to control the angular velocity thereof.

5. A printing machine of a type having a photoconductive drum with a developed image formed thereon being transferred to a receiving medium, wherein the improvement includes:

a transfer drum having an aperture in a portion of the circumferential surface thereof;

a transfer sheet, positioned over the aperture in said transfer drum and secured fixedly at a lead edge to said transfer drum and resiliently at a trailing edge to said transfer drum with a lead edge of the receiving medium being secured fixedly to said transfer sheet and the trailing edge of the receiving medium being unsecured and substantially free, with the transfer drum and the photoconductive drum rotating at substantially equal angular velocities a diameter of and the photoconductive drum being greater than a diameter of the transfer drum so that a tangential velocity of the photoconductive drum is greater than a tangential velocity of the transfer drum in a transfer zone;

a transfer roll disposed interiorly of said transfer drum adjacent said transfer sheet;

a mechanism coupled to said transfer roll to move said transfer sheet adjacent the photoconductive drum to define a nip therebetween through which the receiving medium moves; and an electrical biasing device, operatively associated with said transfer roll, electrically biases said transfer roll and tacks the receiving medium to the photoconductive drum in the transfer zone with the receiving medium moving at the same tangential velocity as the photoconductive drum in the transfer zone causing the receiving medium to buckle after the transfer zone.

6. A printing machine according to claim 5, wherein the receiving medium buckles in the region between the lead edge secured to said transfer sheet and the transfer zone.

7. A printing machine according to claim 6, further including:

a spring attaching resiliently the trailing edge of the transfer sheet to said transfer drum; and a clamping device attaching fixedly the lead edge of the transfer sheet to said transfer drum.

8. A printing machine according to claim 7, further including:

a first servo system, operatively associated with said transfer drum, to control an angular velocity thereof; and a second servo system, operatively associated with the photoconductive drum, to control an angular velocity thereof.

9. A printing machine according to claim 8, wherein said receiving medium includes a sheet.

10. A printing machine according to claim 8, wherein said receiving medium includes an intermediate belt.

11. A printing machine according to claim 5, wherein said transfer drum rotates the receiving medium through the nip a plurality of cycles to transfer a plurality of different color developed images to the receiving medium in registration with one another to form a multicolor image thereon.

* * * * *